US011994307B2

(12) United States Patent
Katsukura

(10) Patent No.: US 11,994,307 B2
(45) Date of Patent: May 28, 2024

(54) AIR CONDITIONING SYSTEM AND MANAGEMENT DEVICE

(71) Applicant: Mitsubishi Electric Corporation, Tokyo (JP)

(72) Inventor: Makoto Katsukura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 381 days.

(21) Appl. No.: 17/429,430

(22) PCT Filed: Feb. 22, 2019

(86) PCT No.: PCT/JP2019/006732
§ 371 (c)(1),
(2) Date: Aug. 9, 2021

(87) PCT Pub. No.: WO2020/170415
PCT Pub. Date: Aug. 27, 2020

(65) Prior Publication Data
US 2022/0128255 A1 Apr. 28, 2022

(51) Int. Cl.
*F24F 11/46* (2018.01)
*F24F 11/61* (2018.01)
*F24F 11/65* (2018.01)

(52) U.S. Cl.
CPC ..... *F24F 11/46* (2018.01); *F24F 11/61* (2018.01); *F24F 11/65* (2018.01)

(58) Field of Classification Search
CPC ..... F24F 11/65; F24F 11/46; F24F 11/61
(Continued)

(56) References Cited

U.S. PATENT DOCUMENTS

2013/0219935 A1* 8/2013 Higaki ..... F25B 49/00 62/126
2015/0019024 A1 1/2015 Sabripour
2015/0330652 A1 11/2015 Kim

FOREIGN PATENT DOCUMENTS

JP 2010-243112 A 10/2010
JP 2011-147413 A 8/2011

OTHER PUBLICATIONS

Decision of Refusal dated Jul. 26, 2022 in connection with counterpart Japanese Patent Application No. 2021-501248 (and English machine translation).

(Continued)

*Primary Examiner* — Jigneshkumar C Patel
(74) *Attorney, Agent, or Firm* — POSZ LAW GROUP, PLC

(57) ABSTRACT

A communication device generates electricity by receiving light and uses the generated electricity to wirelessly transmit communication data. An air conditioner includes an air-conditioner main body that performs air conditioning. An operation state of the air-conditioner main body is caused to be a setback in a case where communication data from the communication device is not transmitted for a predetermined transition time when the operation state of the air-conditioner main body is caused to be in a stop, the setback being a state in which air conditioning of the air-conditioner main body is performed, and the temperature of a space where the air conditioner is placed does not exceed a predetermined limit temperature, the stop being a state in which air conditioning by the air-conditioner main body is not performed.

17 Claims, 8 Drawing Sheets

(58) Field of Classification Search
USPC ..... 700/276
See application file for complete search history.

(56) References Cited

OTHER PUBLICATIONS

International Search Report of the International Searching Authority dated Apr. 2, 2019 for the corresponding international application No. PCT/JP2019/006732 (and English translation).
Office Action dated Jan. 25, 2022, issued in corresponding JP patent application No. 2021-501248 (and English machine translation).

* cited by examiner

AIR CONDITIONING SYSTEM AND MANAGEMENT DEVICE

CROSS REFERENCE TO RELATED APPLICATION

This application is a U.S. national stage application of International Application No. PCT/JP2019/006732 filed on Feb. 22, 2019, the contents of which are incorporated herein by reference.

TECHNICAL FIELD

The present invention relates to an air conditioning system and a management device.

BACKGROUND

A technique has been desired for operating lighting equipment and an air conditioner in conjunction with each other.

However, it is not easy to operate lighting equipment and an air conditioner in conjunction with each other. Communication protocols vary from manufacturer to manufacturer, and it is difficult to determine which light fixture is to operate in conjunction with which air conditioner and establish the settings.

In contrast, there is a technique in which, for example, lights-on information indicating that the light fixture has been turned on or lights-out information indicating that the lighting has been turned off is directly transmitted to an air conditioner to determine whether or not to start the operation of the air conditioner on the basis of the lights-on information or lights-out information (for example, refer to Patent Literature 1).

PATENT REFERENCE

Patent Literature 1: Japanese Patent Application Publication No. 2010-243112

However, in the conventional technique, it is necessary to transmit the lights-on information or the lights-out information to the air conditioner, and thus additional wiring work or the like is required.

SUMMARY

Accordingly, an object of at least one aspect of the present invention is to readily operate lighting equipment and an air conditioner in conjunction with each other.

An air conditioning system according to an aspect of the invention is an air conditioning system including a communication device; and an air conditioner, wherein, the communication device includes an electricity generator to generate electricity by receiving light; and a wireless transmitter to receive a supply of the electricity generated by the electricity generator and to transmit communication data wirelessly; the air conditioner includes an air-conditioner main body to perform air conditioning; and an operation controller to control the air-conditioner main body; and the operation controller causes an operation state of the air-conditioner main body to be in a setback, in a case where the communication data is not transmitted for a predetermined transition time by the wireless transmitter when the operation state is in a stop, the setback being a state in which the air conditioning is performed by the air-conditioner main body so that a temperature in a space where the air conditioner is placed does not exceed a predetermined limit temperature, the stop being a state in which the air conditioning is not performed by the air-conditioner main body.

A management device according to an aspect of the invention includes a unit communicator to communicate with an air conditioner; a wireless receiver to generate electricity by receiving light and wirelessly receiving communication data from a communication device wirelessly transmitting the communication data by the generated electricity; and a management controller to send an operation command for causing an operation state to be in a setback, to the air conditioner via the unit communicator in a case where the wireless receiver does not receive the communication data for a predetermined transmission time when the operation state of the air conditioner is in a stop, the setback being a state in which air conditioning is performed by the air conditioner and the temperature of a space where the air conditioner is placed is prevented from exceeding a predetermined limit temperature.

According to at least one aspect of the present invention, lighting equipment and an air conditioner can be readily operated in conjunction with each other.

DETAILED DESCRIPTION

First Embodiment

Figure 1:
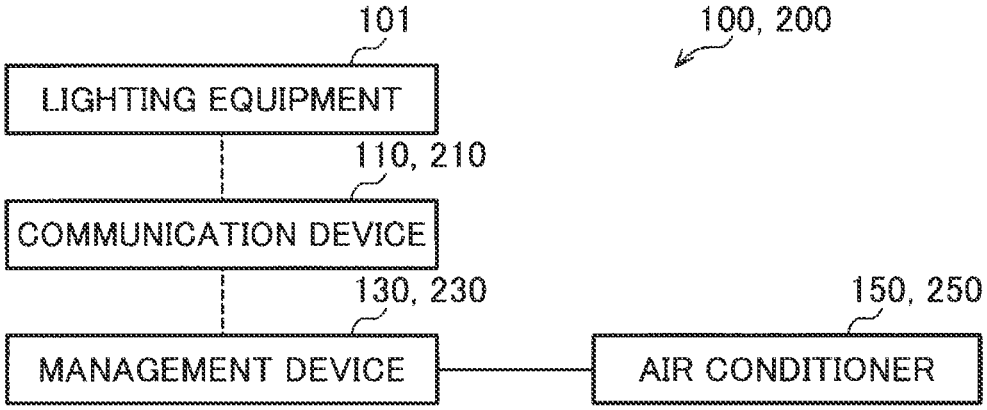
FIG. 1 is a block diagram schematically illustrating the configuration of an air conditioning system according to first and second embodiments.

FIG. 1 is a block diagram schematically illustrating the configuration of an air conditioning system 100 according to a first embodiment.

The air conditioning system 100 includes a communication device 110, a management device 130, and an air conditioner 150. The air conditioning system 100 is a system for operating lighting equipment 101 and the air conditioner 150 in conjunction with each other.

Figure 2:
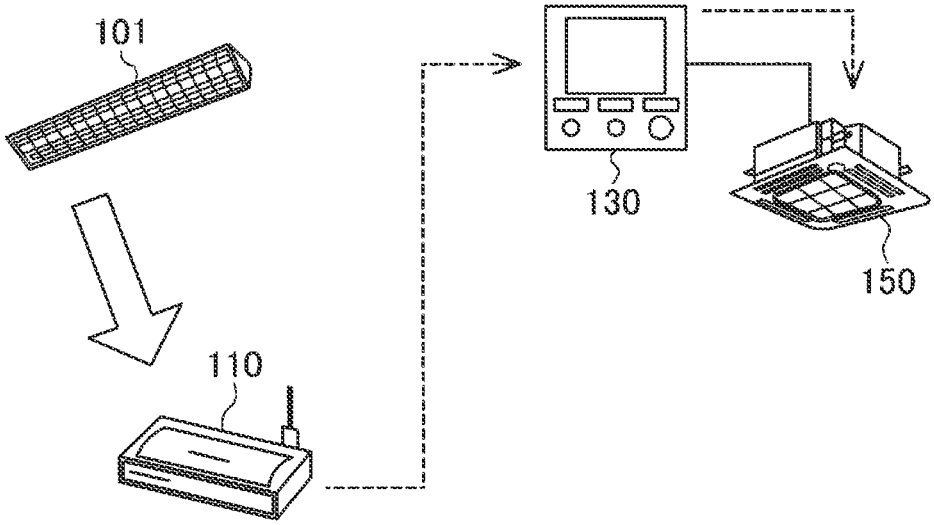
FIG. 2 is a schematic diagram illustrating a placement example of an air conditioning system.

FIG. 2 is a schematic diagram illustrating a placement example of the air conditioning system 100.

As illustrated in FIG. 2, the lighting equipment 101 and the air conditioner 150 are attached to the ceiling of a floor of a large space, such as an office.

The air conditioner 150 is connected to the management device 130 that is a remote controller of the air conditioner 150.

The communication device 110 is disposed on the floor. The communication device 110 has a mechanism for generating electricity by the illumination light emitted from the lighting equipment 101 to obtain activation power.

The communication device 110 has a wireless communication function, and periodically transmits communication data including an ID as a transmission ID to the management device 130, the ID being communication device identification information assigned to the communication device 110 as identification information.

The management device 130 determines whether or not the transmission ID sent from the communication device 110 is a receivable ID. In a case where the transmission ID sent from the communication device 110 is a receivable ID, the management device 130 controls the air conditioner 150 depending on the situation in which the communication data is being sent from the communication device 110.

The air conditioner 150 operates under the control of the management device 130.

Figure 3:
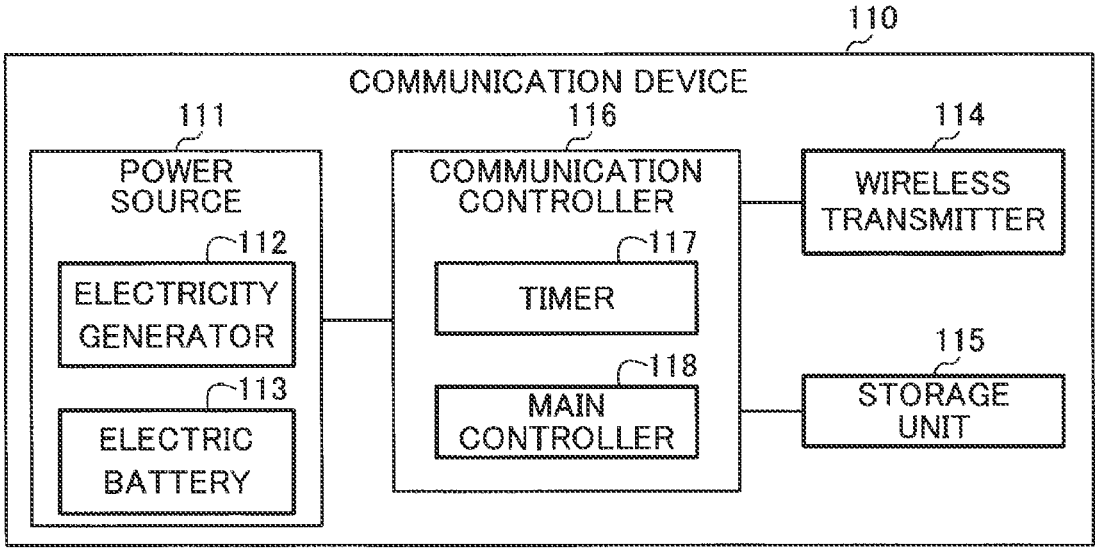
FIG. 3 is a block diagram schematically illustrating the configuration of a communication device according to the first embodiment.

FIG. 3 is a block diagram schematically illustrating the configuration of the communication device 110.

The communication device 110 includes a power source 111, a wireless transmitter 114, a storage unit 115, and a communication controller 116.

The power source 111 generates electricity by receiving light from the lighting equipment 101 and supplies electricity to the communication device 110.

The power source 111 includes an electricity generator 112 and an electric battery 113.

The electricity generator 112 generates electricity by receiving light. For example, the electricity generator 112 generates electricity by converting the light from the lighting equipment 101 into electrical energy.

The electric battery 113 stores the electricity generated by the electricity generator 112 and supplies the stored electricity to each component of the communication device 110.

The wireless transmitter 114 is a wireless communication interface that receives a supply of electricity generated by the electricity generator 112 and performs wireless transmission to the management device 130. For example, the wireless transmitter 114 wirelessly transmits, to the management device 130, communication data including an ID given from the communication controller 116 as a transmission ID. In this example, Bluetooth (registered trademark) or the like is used for the wireless communication.

The storage unit 115 stores information necessary for the processing by the communication device 110. For example, the storage unit 115 stores the ID assigned to the communication device 110 and the transmission time of the communication data.

The communication controller 116 controls the processing by the communication device 110. In this example, the communication device 110 operates in a sleep mode, a power saving mode, or a normal mode, and the communication controller 116 controls the processing in each mode.

The communication controller 116 includes a timer 117 and a main controller 118.

The timer 117 counts activation time that is a predetermined time in the sleep mode. The sleep mode is a mode in which, in the power source 111, the electricity generator 112 is generating electricity, and the electricity is being stored in the electric battery 113. In the sleep mode, the wireless transmitter 114, the storage unit 115, and the main controller 118 stop their operation and do not consume power.

When the counting of the activation time ends in the sleep mode, the timer 117 activates the main controller 118 in the power saving mode.

The main controller 118 controls the processing by the communication device 110 in the power saving mode and the normal mode.

For example, when the main controller 118 receives an activation instruction from the timer 117 in the sleep mode, the main controller 118 is activated and causes the communication device 110 to enter the power saving mode. In the power saving mode, the storage unit 115 is operating, but the wireless transmitter 114 stops its operation and does not consume power.

In the power saving mode, the main controller 118 determines whether or not the amount of stored electricity, which is the amount of electricity stored in the electric battery 113, is greater than or equal to a predetermined threshold value.

Specifically, the main controller 118 measures the voltage of the electric battery 113. In a case where the voltage of the electric battery 113 is higher than or equal to a predetermined voltage, the main controller 118 determines that the amount of stored electricity is greater than or equal to the threshold value. In a case where it is determined that the amount of stored electricity is greater than or equal to the threshold value, the main controller 118 activates the wireless transmitter 114 to cause the communication device 110 to enter the normal mode.

On the other hand, in a case where the voltage of the electric battery 113 is lower than the predetermined voltage, the main controller 118 determines that the amount of stored electricity is smaller than the threshold value. In a case where it is determined that the amount of stored electricity is smaller than the threshold value, the main controller 118 causes the timer 117 to start counting the activation time, stops the operation of the main controller 118 so as not to consume power, and causes the communication device 110 to enter the sleep mode.

In the normal mode, the main controller 118 reads the ID stored in a storage unit 115 and generates communication data including the ID as a transmission ID on the basis of a designated protocol. The main controller 118 then sends the communication data to the wireless transmitter 114 and causes the wireless transmitter 114 to transmit it to the management device 130. Radio waves are output from the wireless transmitter 114 for a very short time. This is because the amount of electricity that can be stored in the electric battery 113 is very small. When the wireless transmitter 114 performs transmission, the electricity stored in the electric battery 113 is almost completely consumed. Therefore, the main controller 118 causes the timer 117 to start counting the activation time, causes the wireless transmitter 114 to stop operation, stops the operation of the main controller 118 so as not to consume power, and causes the communication device 110 to enter the sleep mode so as to store electricity again.

Figure 4A:
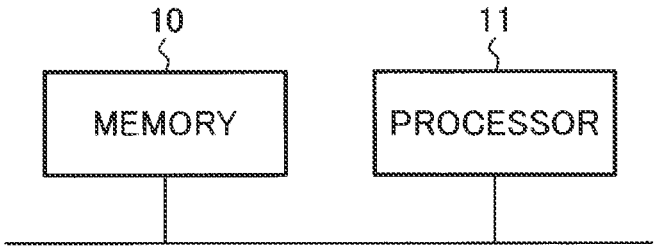
FIGS. 4A and 4B are block diagrams illustrating hardware configuration examples.

A portion or the entirety of the communication controller 116 described above can be implemented by, for example, a memory 10 and a processor 11, such as a central processing unit (CPU), that executes the programs stored in the memory 10, as illustrated in FIG. 4A. Such programs may be provided via a network or may be recorded and provided on a recording medium. That is, such programs may be provided as, for example, program products.

Figure 4B:
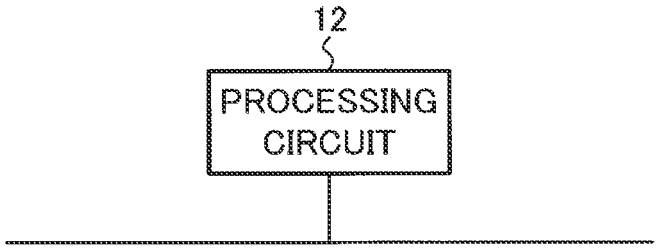

A portion or the entirety of the communication controller 116 can be implemented by, for example, a processing circuit 12, such as a single circuit, a composite circuit, a programmed processor, a parallel programmed processor, an application specific integrated circuit (ASIC), or a field programmable gate array (FPGA), as illustrated in FIG. 4B.

Note that the storage unit 115 can be implemented by a non-volatile memory.

Figure 5:
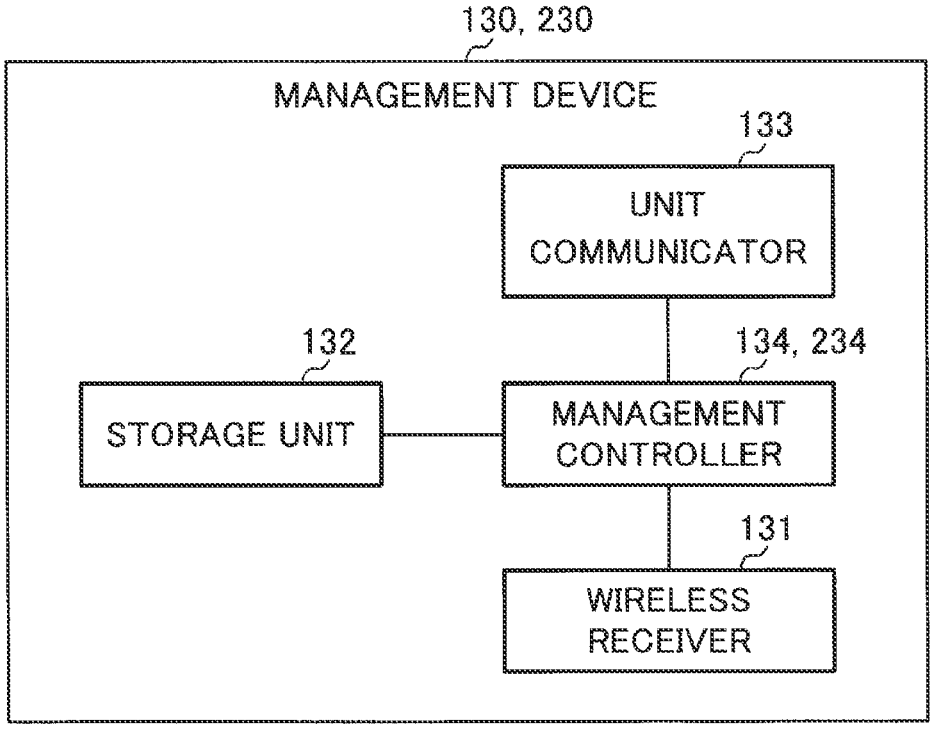
FIG. 5 is a block diagram schematically illustrating the configuration of a management device according to the first and second embodiments.

FIG. 5 is a block diagram schematically illustrating the configuration of the management device 130.

The management device 130 includes a wireless receiver 131, a storage unit 132, a unit communicator 133, and a management controller 134.

The wireless receiver 131 is a wireless communication interface for wirelessly receiving communication data from the communication device 110. For example, the wireless receiver 131 receives communication data from the communication device 110. The received communication data is given to the management controller 134.

The storage unit 132 stores information necessary for the processing by the management device 130. For example, the storage unit 132 stores a receivable ID that is an ID of the communication device 110 that can be received by the management device 130. The receivable ID is also referred to as receivable identification information.

The unit communicator 133 is a communication interface for communicating with the air conditioner 150. In the first embodiment, the management device 130 and the air conditioner 150 are connected by wire, but alternatively may be connected wirelessly.

The management controller 134 controls the processing by the management device 130.

For example, the management controller 134 controls the air conditioner 150 by communicating with the air conditioner 150 via the unit communicator 133.

The management controller 134 also determines whether or not the transmission ID included in the communication data given from the wireless receiver 131 matches the receivable ID stored in the storage unit 132.

In a case where the transmission ID and the receivable ID do not match, the management controller 134 discards the communication data received by the wireless receiver 131.

In a case where the transmission ID and the receivable ID match, the management controller 134 stores the reception time of the communication data received by the wireless receiver 131 in the storage unit 132.

The management controller 134 refers to the reception time stored in the storage unit 132, and in a case where the time passed since the time of the last reception of the communication data is longer than or equal to a transition time or predetermined threshold value when the operation state of the later-described air-conditioner main body 152 of the air conditioner 150 is in a stop, causes the operation state of the air-conditioner main body 152 of the air conditioner 150 to be in a setback. In other words, in a case where the wireless receiver 131 does not receive communication data including a transmission ID matching the receivable ID during the transition time when the operation state of the air-conditioner main body 152 is in the stop, the management controller 134 sends an operation command to the air conditioner 150 via the unit communicator 133 to cause the operation state of the air-conditioner main body 152 to transition to the setback.

A portion or the entirety of the management controller 134 described above can be implemented by, for example, a memory 10 and a processor 11, as illustrated in FIG. 4A. Programs that are to be executed by the processor 11 may be provided via a network or may be recorded and provided on a recording medium. That is, such programs may be provided as, for example, program products.

A portion or the entirety of the management controller 134 can also be implemented by, for example, a processing circuit 12, as illustrated in FIG. 4B.

Note that the storage unit 132 can be implemented by a non-volatile memory.

Figure 6:
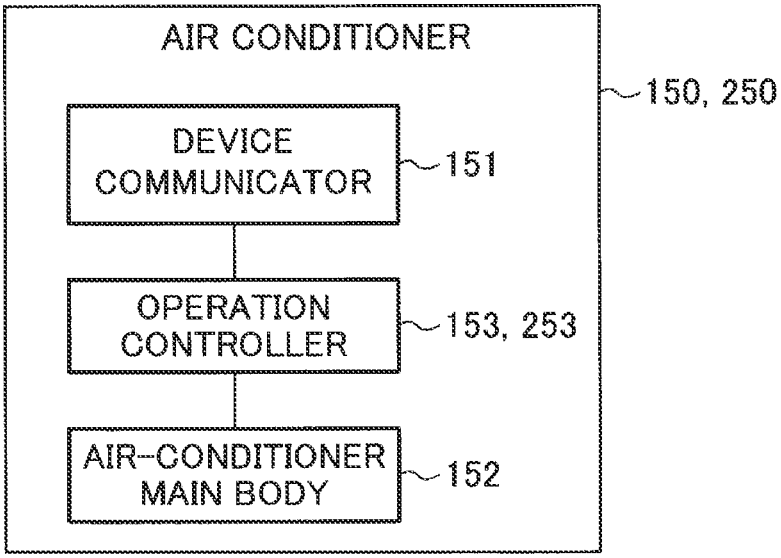
FIG. 6 is a block diagram schematically illustrating the configuration of an air conditioner according to the first embodiment.

FIG. 6 is a block diagram schematically illustrating the configuration of the air conditioner 150.

The air conditioner 150 includes a device communicator 151, an air-conditioner main body 152, and an operation controller 153.

The device communicator 151 is a communication interface for communicating with the management device 130.

The air-conditioner main body 152 performs air conditioning. The air-conditioner main body 152 includes, for example, a motor, a compressor, a condenser, an expansion valve, an evaporator, etc. The air-conditioner main body 152 also includes a detector for detecting the air temperature.

The operation controller 153 controls each component of the air conditioner 150. For example, the operation controller 153 receives an operation command from the management device 130 via the device communicator 151 and controls the air-conditioner main body 152 in accordance with the received operation command. Specifically, the operation controller 153 controls the operation state, the operation mode, the set temperature, the air volume, the wind direction, etc., of the air-conditioner main body 152. In the first embodiment, the operation modes are heating, cooling, drying, and blowing.

In the first embodiment, the operation states are operation, stop, and setback.

The operation is a state in which the air-conditioner main body 152 performs air conditioning to make the temperature in the space where the air conditioner 150 is placed become a set temperature.

The stop is a state in which the air-conditioner main body 152 is not performing air conditioning.

The setback is a state in which the air-conditioner main body 152 performs air conditioning so that the temperature in the space where the air conditioner 150 is placed may not exceed a predetermined limit temperature.

In this example, the setback is a state in which the operation of the air conditioner 150 is weakened for the purpose of facility maintenance. In the first embodiment, an upper limit temperature and a lower limit temperature are determined as limit temperatures, and in the setback, the air-conditioner main body 152 performs air conditioning so that the environmental temperature, which is the temperature of the space where the air conditioner 150 is placed, does not exceed the upper limit temperature or fall below the lower limit temperature, in other words, the environmental temperature is set between the upper limit temperature and the lower limit temperature.

Normally, the upper limit temperature is a temperature at which the operation mode of the air-conditioner main body 152 needs to be set to cooling, and the lower limit temperature is a temperature at which the operation mode of the air-conditioner main body 152 needs to be set to heating. Therefore, the operation controller 153 changes the operation mode of the air-conditioner main body 152 depending on the environmental temperature so that the environmental temperature falls between the upper limit temperature and the lower limit temperature.

Note that, in the first embodiment, the upper limit temperature and the lower limit temperature are set as the limit temperatures, but alternatively only one of them may be set. Note that the environmental temperature may be detected by a detector (not illustrated) provided in the air-conditioner main body 152.

In a case where the communication device 110 does not transmit communication data for a predetermined transition time while the operation state of the air-conditioner main body 152 is in the stop, the operation controller 153 causes the operation state to be in the setback.

In a case where the communication device 110 transmits multiple pieces of communication data within a predetermined recovery time while the operation state is in the setback, the operation controller 153 causes the operation state to be in the stop.

A portion or the entirety of the operation controller 153 described above can be implemented by, for example, a memory 10 and a processor 11, as illustrated in FIG. 4A. Programs that are to be executed by the processor 11 may be provided via a network or may be recorded and provided on a recording medium. That is, such programs may be provided as, for example, program products.

A portion or the entirety of the operation controller 153 can also be implemented by, for example, a processing circuit 12, as illustrated in FIG. 4B.

Figure 7:
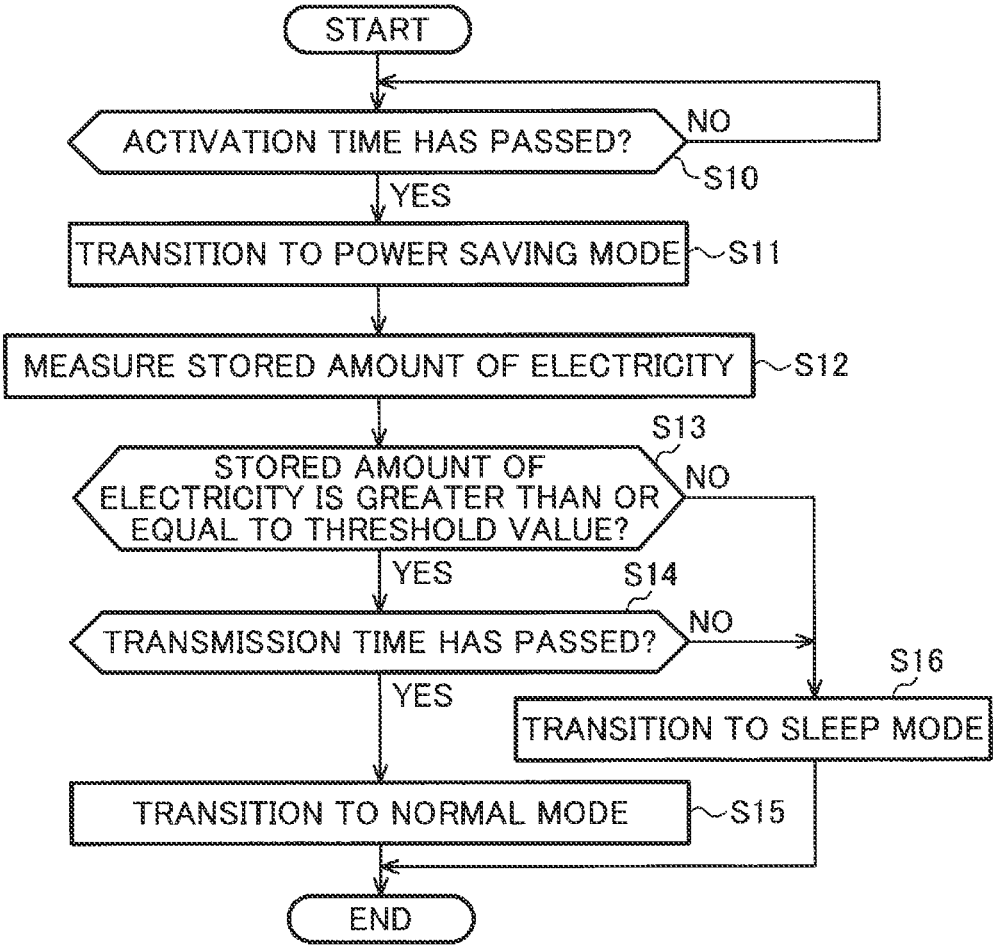
FIG. 7 is a flowchart illustrating the operation of the communication device in a sleep mode and a power saving mode in the first embodiment.

FIG. 7 is a flowchart illustrating the operation of the communication device 110 in the sleep mode and the power saving mode.

In the flowchart illustrated in FIG. 7, first, the communication device 110 is in the sleep mode.

The timer 117 determines whether or not a predetermined activation time has passed (step S10). If the activation time has passed, the process proceeds to step S11.

In step S11, the main controller 118 and the storage unit 115 are activated, and the communication device 110 transitions to the power saving mode. In this example, the power saving mode is a mode in which the main controller 118 operates at a very low clock and stops all the functions of the wireless transmitter 114. For example, in the power saving mode, it is desirable to reduce the power consumption to approximately 1/100 of that in the normal mode.

The main controller 118 measures the amount of stored electricity in the electric battery 113 to determine whether or not the amount of the stored electricity in the electric battery 113 is sufficient to transition to the normal mode (step S12). In this example, the main controller 118 measures the voltage of the electricity stored in the electric battery 113.

The main controller 118 then determines whether or not the amount of stored electricity is greater than or equal to a threshold value (step S13). For example, the main controller 118 may perform this determination on the basis of whether or not the voltage measured in step S12 is higher than or equal to a voltage that is the threshold value. If the amount of stored electricity is greater than or equal to the threshold value (Yes in step S13), the process proceeds to step S14, and if the amount of stored electricity is smaller than the threshold value (No in step S13), the process proceeds to step S16.

In step S14, the main controller 118 refers to the transmission time of the communication data stored in the storage unit 115 to determine whether or not a transmission time, which is a predetermined time, has passed since the previous transmission time of the communication data. If the transmission time has passed (Yes in step S14), the process proceeds to step S15, and if the transmission time has not passed (No in step S14), the process proceeds to step S16.

In step S15, the main controller 118 activates the wireless transmitter 114 to cause the communication device 110 to transition to the normal mode.

On the other hand, in step S16, the main controller 118 stops the functions of the main controller 118 and the storage unit 115 to cause the communication device 110 to transition to the sleep mode. Note that before the function of the main controller 118 is stopped, the main controller 118 sets the activation time to the timer 117 and causes the timer 117 to start counting.

In this example, it is desirable that the activation time in step S10 be shorter than the transmission time in step S14. For example, it is desirable that the activation time be approximately one second and the transmission time be approximately ten seconds.

Figure 8:
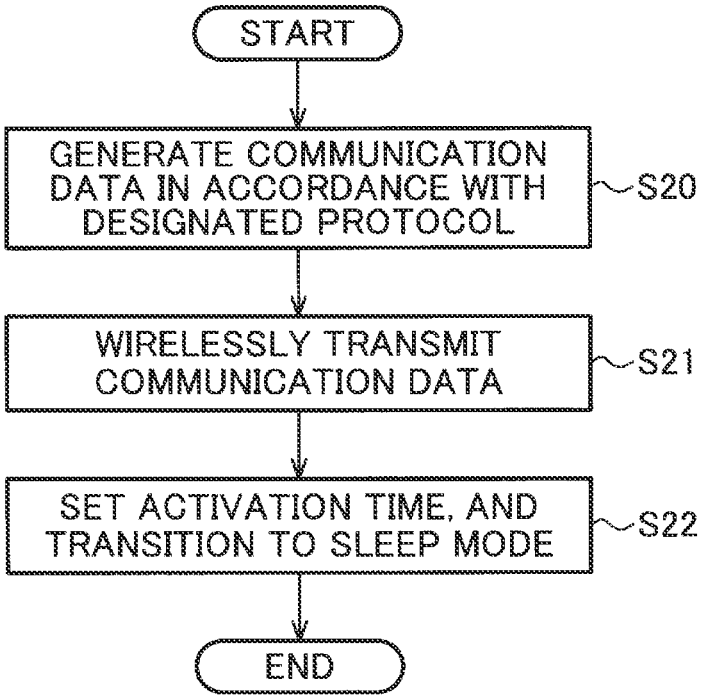
FIG. 8 is a flowchart illustrating the operation of the communication device in a normal mode in the first embodiment.

FIG. 8 is a flowchart illustrating the operation of the communication device 110 in the normal mode.

First, when the mode transitions to the normal mode, the main controller 118 reads the ID stored in the storage unit 115 and generates communication data including the ID as a transmission ID on the basis of a designated protocol (step S20). The main controller 118 gives the generated communication data to the wireless transmitter 114.

The wireless transmitter 114 wirelessly transmits the communication data given from the main controller 118 to the management device 130 (step S21).

The main controller 118 then stops the functions of the main controller 118, the storage unit 115, and the wireless transmitter 114 to cause the communication device 110 to transition to the sleep mode (step S22). Note that before the function of the main controller 118 is stopped, the main controller 118 sets the activation time to the timer 117 and causes the timer 117 to start counting.

As described above, according to the flowcharts illustrated in FIGS. 7 and 8, as long as light is being received from the lighting equipment 101, the communication device 110 periodically transmits communication data to the management device 130.

Figure 9:
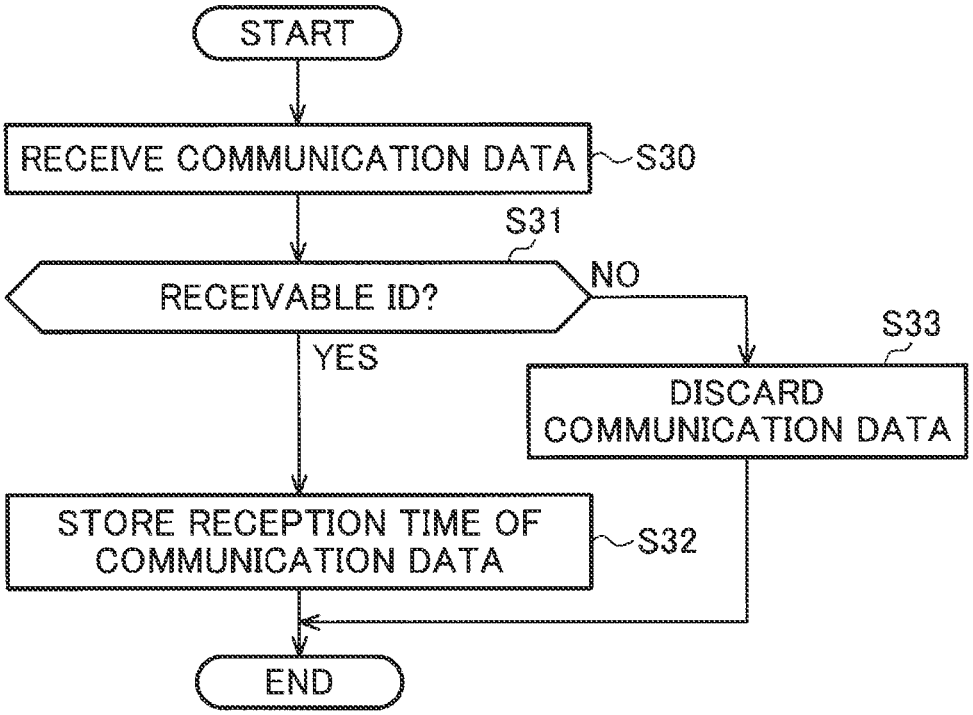
FIG. 9 is a flowchart illustrating the operation of the management device when communication data is received in the first embodiment.

FIG. 9 is a flowchart illustrating the operation of the management device 130 when communication data is received.

In the management device 130, the wireless receiver 131 wirelessly receives communication data (step S30). The received communication data is given to the management controller 134. Note that the wireless receiver 131 receives the communication data regardless of whether or not the communication data is from the communication device 110.

When the communication data is received from the wireless receiver 131, the management controller 134 determines whether or not the transmission ID included in the communication data matches the receivable ID stored in the storage unit 132 (step S31). If the transmission ID matches the receivable ID (Yes in step S31), the process proceeds to step S32, and if the transmission ID does not match the receivable ID (No in step S31), the process proceeds to step S33.

In step S32, the management controller 134 stores the reception time of the communication data received by the wireless receiver 131 in the storage unit 132.

On the other hand, in step S33, the management controller 134 discards the received communication data.

Figure 10:
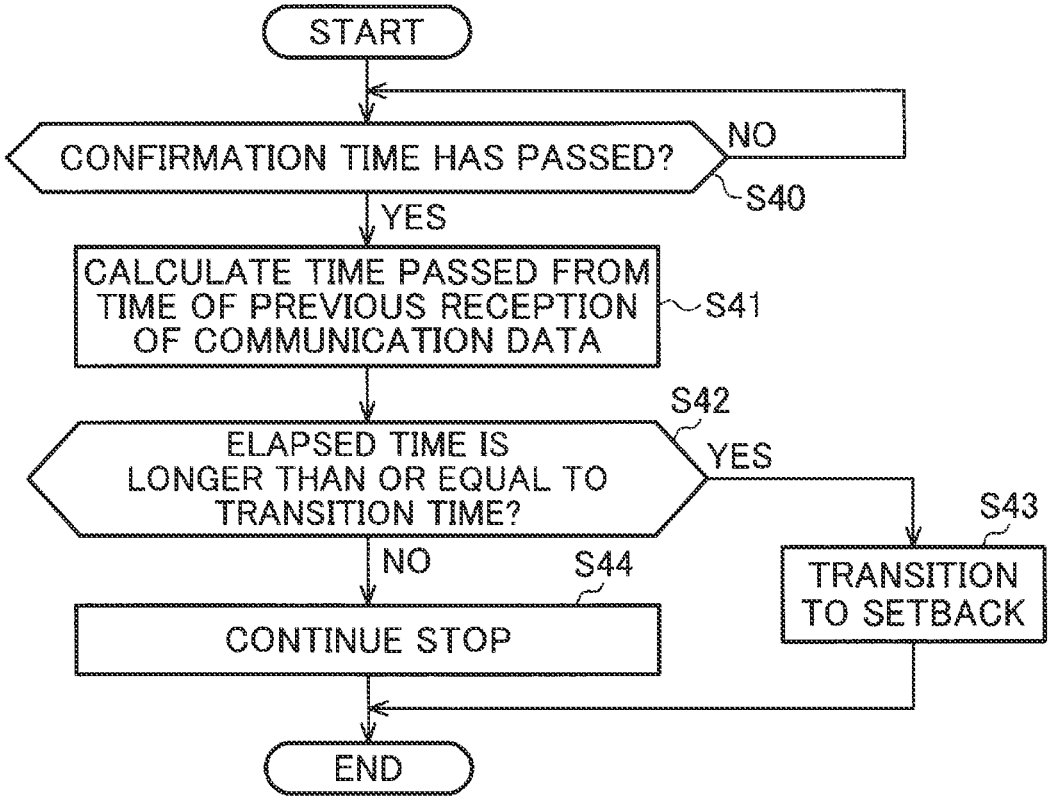
FIG. 10 is a flowchart illustrating the operation of the management device in a case where the operation state of an air-conditioner main body is in a setback in the first embodiment.

FIG. 10 is a flowchart illustrating the operation of the management device 130 in a case where the operation state of the air-conditioner main body 152 is in the stop.

According to the flowcharts illustrated in FIGS. 7 and 8, the communication device 110 periodically and wirelessly transmits communication data. However, in a case where the lighting equipment 101 is turned off, the electricity generator 112 of the communication device 110 does not generate electricity, and thus the transmission of the communication data from the communication device 110 is interrupted.

In this example, the flowchart illustrated in FIG. 10 is performed in a case where the operation state of the air-conditioner main body 152 is in the stop.

First, the management controller 134 of the management device 130 determines whether or not a predetermined confirmation time has passed (step S40). If the predetermined confirmation time has passed (Yes in step S40), the process proceeds to step S41.

In step S41, the management controller 134 checks the reception time of the communication data stored in the storage unit 132 to calculate the time that has passed since the time of the previous reception of communication data.

The management controller 134 then determines whether or not the calculated elapsed time is longer than or equal to the transition time that is the threshold value (step S42). If the elapsed time is longer than or equal to the transition time (Yes in step S42), the process proceeds to step S43. If the elapsed time is shorter than the transition time (No in step S42), the process proceeds to step S44.

In step S43, the management controller 134 switches the operation state of the air-conditioner main body 152 to the setback because the reception of the communication data is interrupted. For example, the management controller 134 sends an operation command for the setback to the air conditioner 150 via the unit communicator 133 to switch the operation state of the air-conditioner main body 152 to the setback. The management controller 134 then sets the confirmation time again and counts the confirmation time.

In step S44, the management controller 134 continues the operation state of the air-conditioner main body 152 as it is because the reception of the communication data is not interrupted. In other words, in this example, the management controller 134 does not send an operation command to the air conditioner 150. The management controller 134 then sets the confirmation time again and counts the confirmation time.

In this example, it is desirable that the confirmation time in step S40 be shorter than the transition time in step S42. For example, it is desirable that the confirmation time be approximately one minute and the transition time be approximately ten minutes.

Figure 11:
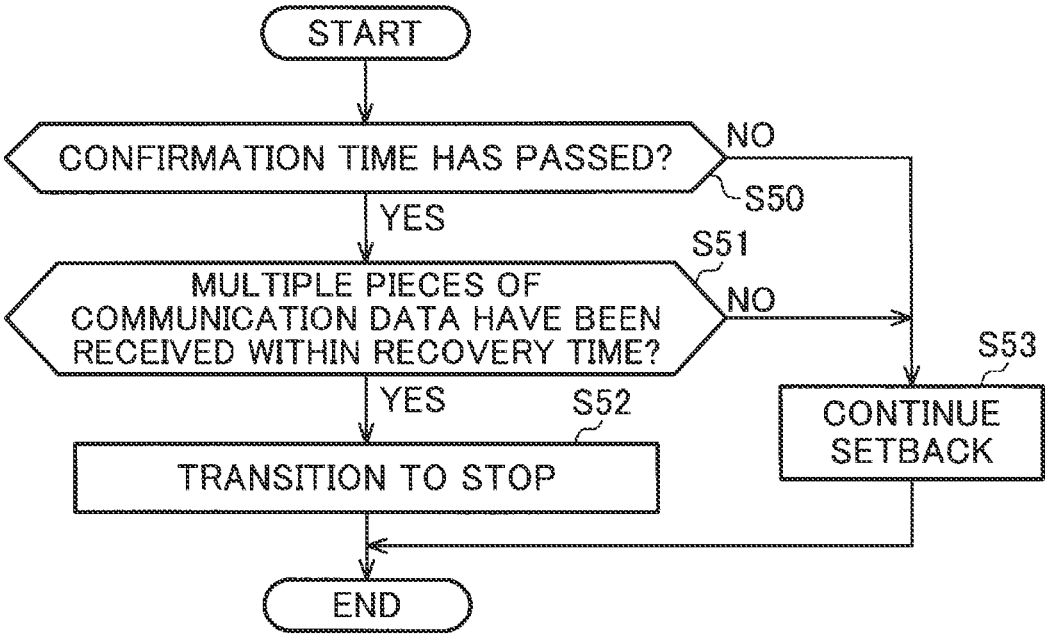
FIG. 11 is a flowchart illustrating the operation of the management device in a case where the operation state of the air-conditioner main body is in the setback in the first embodiment.

FIG. 11 is a flowchart illustrating the operation of the management device 130 performed in a case where the operation state of the air-conditioner main body 152 is in the setback.

First, the management controller 134 of the management device 130 determines whether or not a predetermined confirmation time has passed (step S50). If the predetermined confirmation time has passed (Yes in step S50), the process proceeds to step S51.

In step S51, the management controller 134 confirms the reception time of the communication data stored in the storage unit 132, and determines whether or not multiple pieces of communication data have been received within the recovery time, which is a predetermined time, after the operation state has entered the setback (step S51). If multiple pieces of communication data have been received within the recovery time (Yes in step S51), the process proceeds to step S52, and if multiple pieces of communication data have not been received within the recovery time (No in step S51), the process proceeds to step S53.

In step S52, the management controller 134 switches the operation state of the air-conditioner main body 152 to the stop because the transmission of the communication data is resumed. Specifically, the management controller 134 sends an operation command of the stop to the air conditioner 150 via the unit communicator 133 to switch the operation state of the air-conditioner main body 152 to the stop. The management controller 134 then sets the confirmation time again and counts the confirmation time.

In step S53, the management controller 134 continues the operation state of the air-conditioner main body 152 in the setback because the transmission of the communication data has not been resumed. In other words, in this example, the management controller 134 does not send an operation command to the air conditioner 150. The management controller 134 then sets the confirmation time again and counts the confirmation time.

Note that it is desirable that the recovery time in step S51 be a time shorter than or equal to the confirmation time in step S50 and longer than or equal to the transmission time in step S14 in FIG. 7. For example, it is desirable that the recovery time be 30 seconds in a case where the confirmation time is one minute and the transmission time is ten seconds.

Second Embodiment

As illustrated in FIG. 1, an air conditioning system 200 according to a second embodiment includes a communication device 210, a management device 230, and an air conditioner 250.

The air conditioning system 200 according to the second embodiment is also a system for operating the lighting equipment 101 and the air conditioner 250 in conjunction with each other.

Figure 12:
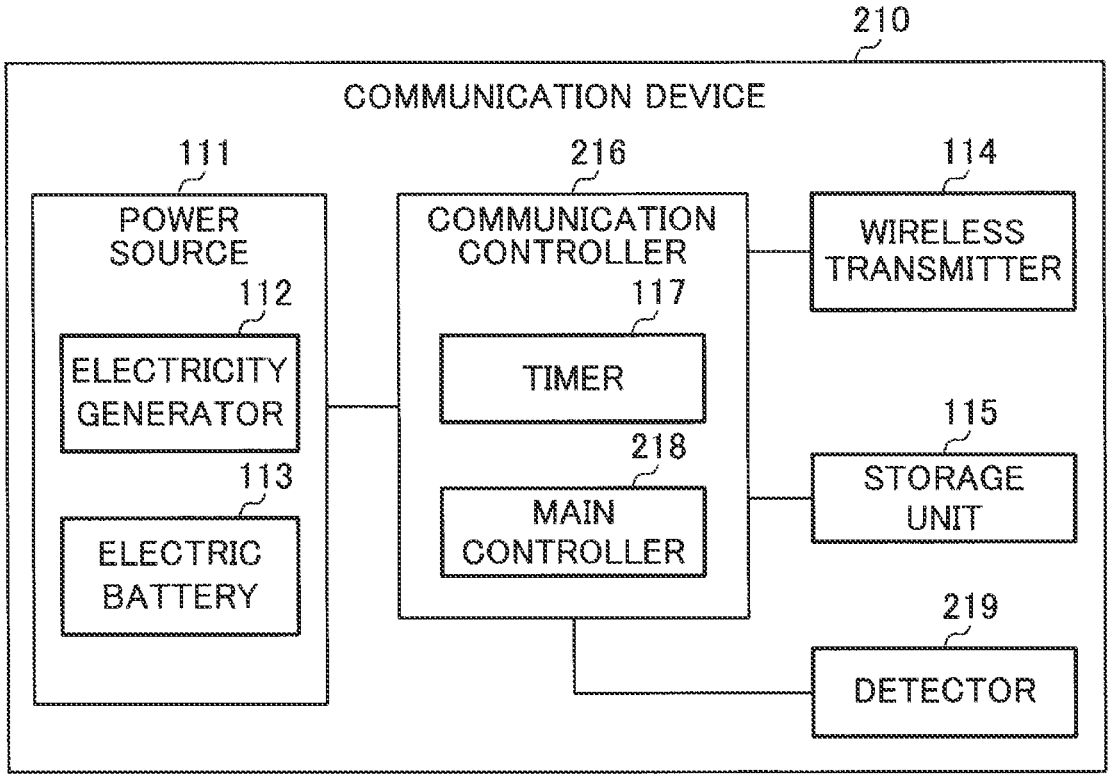
FIG. 12 is a block diagram schematically illustrating the configuration of a communication device according to the second embodiment.

FIG. 12 is a block diagram schematically illustrating the configuration of the communication device 210 according to the second embodiment.

The communication device 210 includes a power source 111, a wireless transmitter 114, a storage unit 115, a communication controller 216, and a detector 219.

The power source 111, the wireless transmitter 114, and the storage unit 115 according to the second embodiment are the same as the power source 111, the wireless transmitter 114, and the storage unit 115, respectively, according to the first embodiment.

The detector 219 detects a physical quantity.

For example, the detector 219 detects a physical quantity relating to the space where the communication device 210 is placed, depending on an instruction from the communication controller 216. In the second embodiment, the detector 219 is a temperature sensor serving as a temperature detector for detecting a temperature. Specifically, the detector 219 is provided with an air hole for generating air convection so that air flows little by little. Therefore, the detector 219 can detect a temperature at the site where the communication device 210 is placed.

The communication controller 216 controls the processing by the communication device 210. In the second embodiment, also, the communication device 210 operates in the sleep mode, the power saving mode, or the normal mode, and the communication controller 216 controls the processing in each mode.

The communication controller 216 includes a timer 117 and a main controller 218.

The timer 117 according to the second embodiment is the same as the timer 117 according to the first embodiment.

The main controller 218 controls the processing by the communication device 210 in the power saving mode and the normal mode.

For example, when an activation instruction from the timer 117 is received in the sleep mode, the main controller 218 is activated and causes the communication device 210 to be in the power saving mode. In the power saving mode, the storage unit 115 is operating, but the wireless transmitter 114 and the detector 219 stop their operation and do not consume power.

In the power saving mode, the main controller 218 measures the amount of stored electricity in the electric battery 113, as in the first embodiment. In a case where it is determined that the amount of stored electricity in the electric battery 113 is greater than or equal to a threshold value and a predetermined transmission time has passed since the previous time of transmission of communication data, the main controller 218 activates the wireless transmitter 114 and the detector 219 to cause the communication device 210 to enter the normal mode.

On the other hand, in a case where the amount of stored electricity in the electric battery 113 is smaller than the threshold value or in a case where the predetermined transmission time has not passed since the previous time of transmission of the communication data, the main controller 218 causes the timer 117 to start counting the activation time, stops the operation of the main controller 218 so as not to consume electricity, and causes the communication device 210 to enter the sleep mode.

In the normal mode, the main controller 218 instructs the detector 219 to detect the temperature. The main controller 218 then reads the ID stored in the storage unit 115 and generates, on the basis of a designated protocol, communication data including temperature information indicating the temperature detected by the detector 219 and a transmission ID that is the read ID. The temperature information is information indicating the physical quantity detected by the detector 219.

The main controller 218 sends the generated communication data to the wireless transmitter 114 and causes the wireless transmitter 114 to transmit it to the management device 130. The main controller 218 then causes the timer 117 to start counting the activation time, causes the wireless transmitter 114 and the detector 219 to stop operation, stops the operation of the main controller 218 so as not to consume electricity, and thereby causes the communication device 210 to enter the sleep mode so that electricity is stored again.

As illustrated in FIG. 5, the management device 230 according to the second embodiment includes a wireless receiver 131, a storage unit 132, a unit communicator 133, and a management controller 234.

The wireless receiver 131, the storage unit 132, and the unit communicator 133 according to the second embodiment are the same as the wireless receiver 131, the storage unit 132, and the unit communicator 133, respectively, according to the first embodiment.

The management controller 234 controls the processing by the management device 230.

The management controller 234 according to the second embodiment performs the same processing as that performed by the management controller 134 according to the first embodiment, reads the temperature information included in the communication data received by the wireless receiver 131, and causes the unit communicator 133 to transmit the read temperature information to the air conditioner 250.

As illustrated in FIG. 6, the air conditioner 250 according to the second embodiment includes a device communicator 151, an air-conditioner main body 152, and an operation controller 253.

The device communicator 151 and the air-conditioner main body 152 according to the second embodiment are the same as the device communicator 151 and the air-conditioner main body 152, respectively, according to the first embodiment.

The operation controller 253 controls the processing by the air conditioner 250.

The operation controller 253 according to the second embodiment performs the same processing as that performed by the operation controller 153 according to the first embodiment, and controls the air-conditioner main body 152 on the basis of the temperature indicated by the temperature information received by the device communicator 151. For example, in a case where the operation state of the air-conditioner main body 152 is in the operation, the operation controller 253 controls the air-conditioner main body 152 so that the temperature indicated by the temperature information becomes a set temperature.

Figure 13:
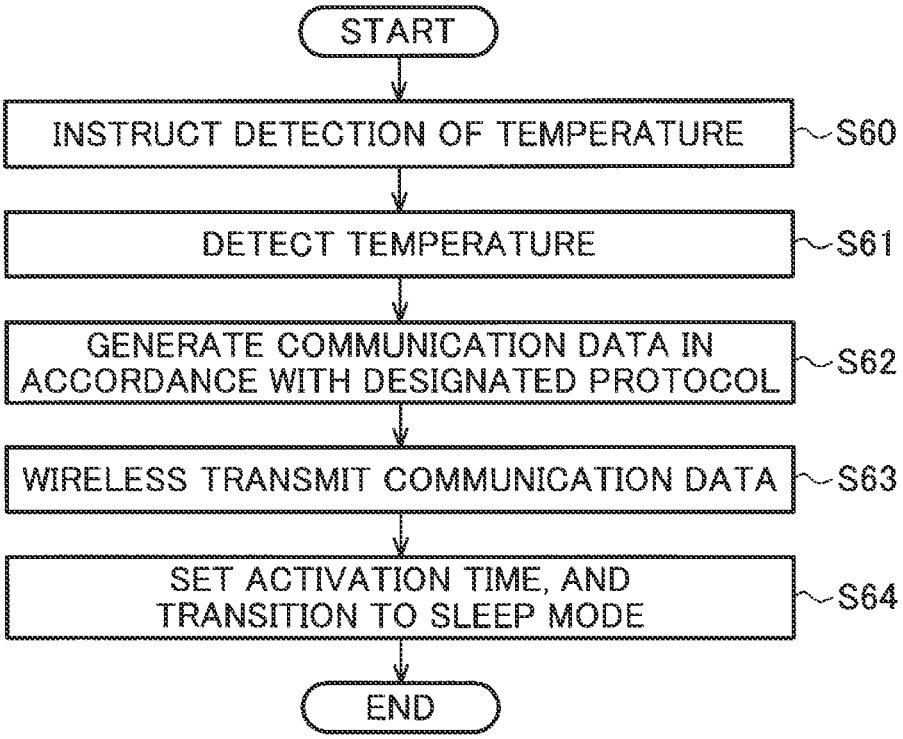
FIG. 13 is a flowchart illustrating the operation of the communication device in the normal mode in the second embodiment.

FIG. 13 is a flowchart illustrating the operation of the communication device 210 in the normal mode.

Note that when the communication device 210 transitions from the power saving mode to the normal mode, the main controller 218 activates the detector 219 as well as the wireless transmitter 114.

First, when the mode transitions to the normal mode, the main controller 218 instructs the detector 219 to detect the temperature (step S60).

In response to such an instruction, the detector 219 detects the temperature (step S61). Specifically, the detector 219 enables a voltage measurement circuit and measures, with high accuracy, the voltage output from a temperature element to measure the temperature. The detector 219 then performs such measurement multiple times and notifies the main controller 218 of the mean value of the measured temperatures as the detected temperature.

The main controller 218 reads the ID stored in the storage unit 115 and, on the basis of a designated protocol, generates communication data including the transmission ID that is the read ID and the temperature information indicating the temperature from the detector 219 (step S62). The main controller 218 gives the generated communication data to the wireless transmitter 114.

The wireless transmitter 114 wirelessly transmits the communication data given from the main controller 218 to the management device 230 (step S63).

The main controller 218 then stops the functions of the main controller 218, the storage unit 115, the wireless transmitter 114, and the detector 219 to cause the communication device 210 to transition to the sleep mode (step S64). Note that before the function of the main controller 218 stops, the main controller 218 sets the activation time to the timer 117 and causes the timer 117 to start counting.

As described above, in the second embodiment, as long as light is received from the lighting equipment 101, the communication device 210 periodically transmits communication data including temperature information, to the management device 230.

Figure 14:
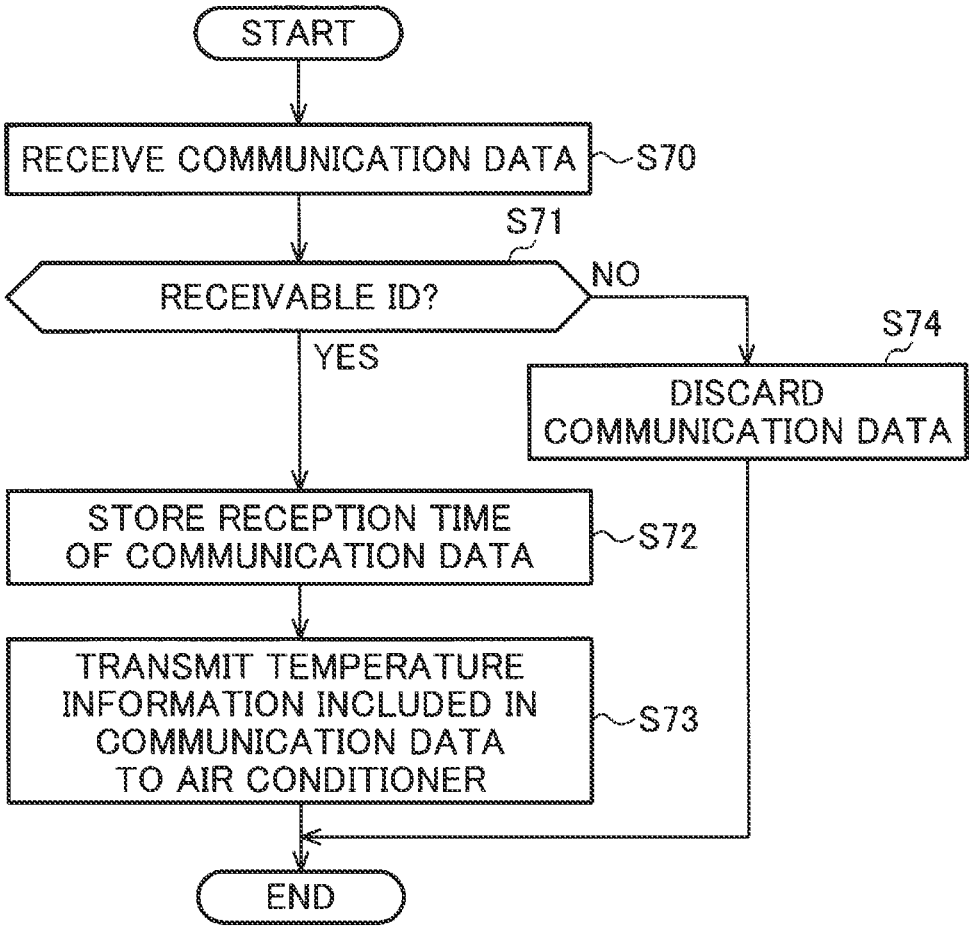
FIG. 14 is a flowchart illustrating the operation of a management device when communication data is received in the second embodiment.

FIG. 14 is a flowchart illustrating the operation of the management device 230 when communication data is received in the second embodiment.

In the management device 230, the wireless receiver 131 wirelessly receives communication data (step S70). The received communication data is given to the management controller 234. Note that the wireless receiver 131 receives the communication data regardless of whether or not the communication data is transmitted from the communication device 210.

When communication data is received from the wireless receiver 131, the management controller 234 determines whether or not the transmission ID included in the communication data matches the receivable ID stored in the storage unit 132 (step S71). If the transmission ID matches the receivable ID (Yes in step S71), the process proceeds to step S72, and if the transmission ID does not match the receivable ID (No in step S71), the process proceeds to step S74.

In step S72, the management controller 234 stores the reception time of the communication data received by the wireless receiver 131, in the storage unit 132.

The management controller 234 then reads the temperature information included in the communication data, gives the read temperature information to the unit communicator 133, and causes the unit communicator 133 to transmit it to the air conditioner 250 (step S73).

On the other hand, in step S74, the management controller 234 discards the received communication data.

As described above, according to the second embodiment, the same effect as that in the first embodiment can be achieved, and the air conditioner 250 can be controlled depending on the environment in which the communication device 210 is placed.

Note that in a case where the temperature information is not sent from the communication device 210, the air conditioner 250 may operate on the basis of, for example, a temperature detected by a detector (not illustrated) provided in the air-conditioner main body 152.

Third Embodiment

Figure 15:
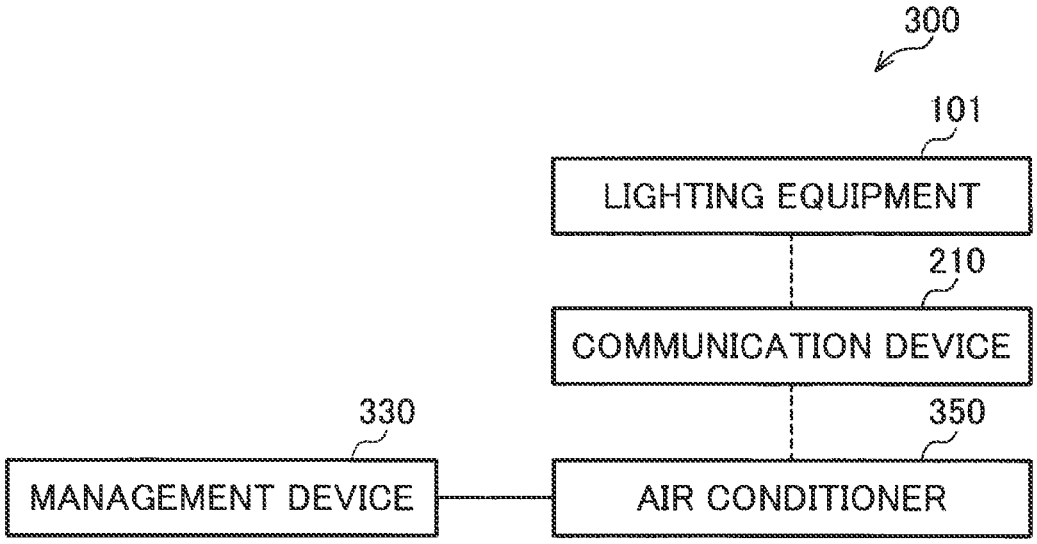
FIG. 15 is a block diagram schematically illustrating the configuration of an air conditioning system according to a third embodiment.

FIG. 15 is a block diagram schematically illustrating the configuration of an air conditioning system 300 according to a third embodiment.

The air conditioning system 300 includes a communication device 210, a management device 330, and an air conditioner 350. In the third embodiment, also, the air conditioning system 300 is a system for operating lighting equipment 101 and the air conditioner 350 in conjunction with each other.

Note that the communication device 210 according to the third embodiment is the same as the communication device 210 according to the second embodiment.

As illustrated in FIG. 15, in the air conditioning system 300 according to the third embodiment, the communication data transmitted from the communication device 210 is received by the air conditioner 350, and the received communication data is transferred from the air conditioner 350 to the management device 330. This will now be described in detail.

Figure 16:
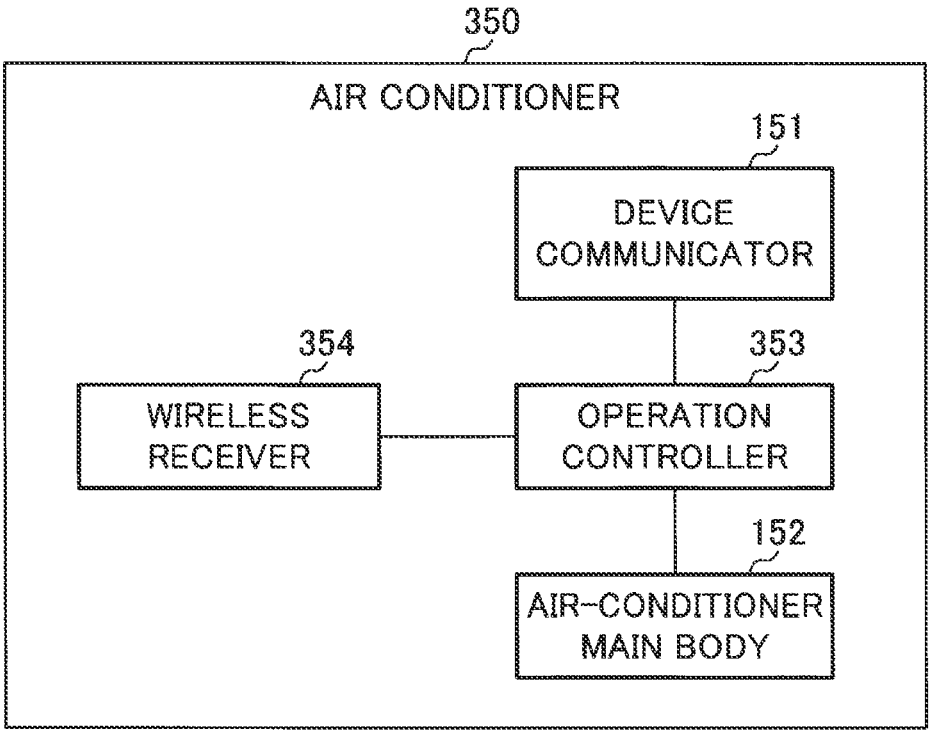
FIG. 16 is a block diagram schematically illustrating the configuration of an air conditioner according to the third embodiment.

FIG. 16 is a block diagram schematically illustrating the configuration of the air conditioner 350 according to the third embodiment.

The air conditioner 350 includes a device communicator 151, an air-conditioner main body 152, an operation controller 353, and a wireless receiver 354.

The device communicator 151 and the air-conditioner main body 152 according to the third embodiment are the same as the device communicator 151 and the air-conditioner main body 152, respectively, according to the first embodiment.

The wireless receiver 354 is a wireless communication interface for wirelessly receiving communication data from the communication device 210. Note that the wireless receiver 354 gives the received communication data to the operation controller 353.

The operation controller 353 controls the processing by the air conditioner 350.

The operation controller 353 according to the third embodiment performs the same processing as that performed by the operation controller 253 according to the second embodiment, gives the communication information given from the wireless receiver 354 to the device communicator 151, and causes the device communicator 151 to send it to the management device 330.

Note that in the second embodiment, the operation controller 253 acquires temperature information from the device communicator 151, but in the third embodiment, the operation controller 353 acquires the temperature information included in the communication data given from the wireless receiver 354 and uses it to control the air-conditioner main body 152.

Figure 17:
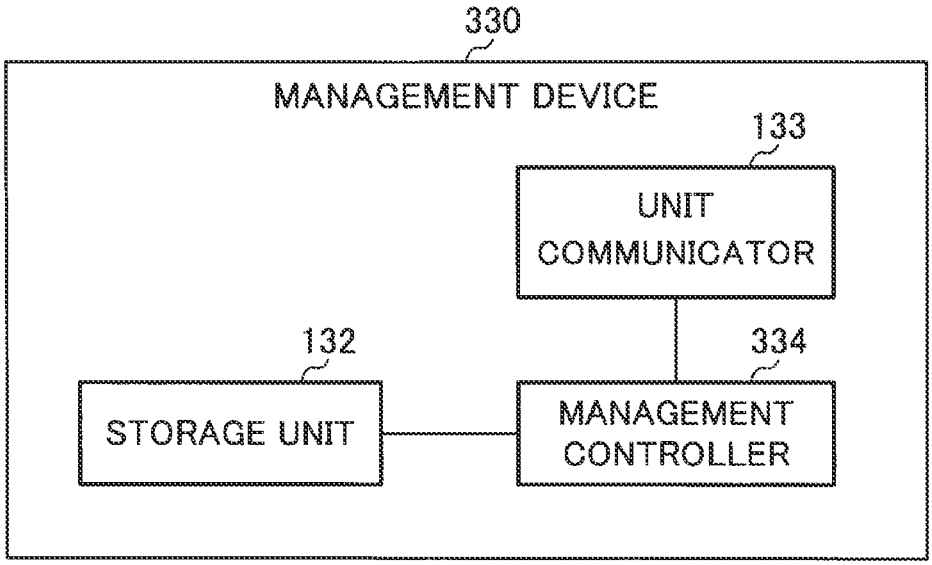
FIG. 17 is a block diagram schematically illustrating the configuration of a management device according to the third embodiment.

FIG. 17 is a block diagram schematically illustrating the configuration of the management device 330.

The management device 330 includes a storage unit 132, a unit communicator 133, and a management controller 334.

The storage unit 132 and the unit communicator 133 according to the third embodiment are the same as the storage unit 132 and the unit communicator 133, respectively, according to the first embodiment.

The management controller 334 controls the processing by the management device 330.

The management controller 334 according to the third embodiment performs the same processing as that performed by the management controller 234 according to the second embodiment. However, while the management controller 234 according to the second embodiment acquires temperature information included in the communication data given from the wireless receiver 131 illustrated in FIG. 5, the management controller 334 according to the third embodiment acquires temperature information included in the communication data given from the unit communicator 133. Therefore, the wireless receiver 131 illustrated in FIG. 5 is not provided in the third embodiment, and the management controller 334 need not send temperature information to the air conditioner 350 via the unit communicator 133.

As described above, since the communication device 210 communicates with the air conditioner 350 in the third embodiment, even when the air conditioner 350 and the management device 330 are disposed far apart from each other, the communication device 210 can be disposed close to the air conditioner 350. Therefore, the communication device 210 can detect physical quantities in an environment close to that of the air conditioner 350.

Note that the communication device 210 according to the third embodiment is the same as the communication device 210 according to the second embodiment, but the third embodiment is not limited to such an example. For example, the communication device 110 according to the first embodiment may be used in the air conditioning system 300 according to the third embodiment. In such a case, the operation controller 353 of the air conditioner 350 and the management controller 334 of the management device 330 need not perform the processing related to the temperature information from the communication device 210.

As described above, according to the first to third embodiments, the operation state of the air-conditioner main body 152 of the air conditioner 150 can be switched in conjunction with the light from the lighting equipment 101. In this example, by causing the operation state of the air-conditioner main body 152 to be in the setback in a case where the lighting equipment 101 is turned off, the facility in the space where the air conditioners 150 to 350 are placed can be maintained.

In a case where the operation state is in the setback, the facility in the space where the air conditioners 150 to 350 are placed can be reliably maintained by setting the temperature at which the air-conditioner main body 152 needs to perform cooling to the upper limit temperature and setting the temperature at which the air-conditioner main body 152 needs to perform heating to the lower limit temperature.

By switching the operation state of the air-conditioner main body 152 from the setback to the stop in a case where the lighting equipment 101 is turned on, the air conditioners 150 to 350 can be operated on the basis of the decision by the user.

By receiving the communication data from the communication devices 110 and 210 by the management devices 130 and 230, respectively, the management devices 130 and 230 can readily manage the air conditioners 150 and 250, respectively, depending on the communication data.

The communication device 210 can be disposed close to the user, a physical quantity can be detected, and the detected physical quantity can be sent from the communication device 210 to the air conditioner 250 via the management device 230, to control the air-conditioner main body 152 depending on the physical quantity of the space close to the user of the air conditioner 250.

By setting the physical quantity detected by the communication device 210 to be a temperature, the air-conditioner main body 152 can be controlled depending on the temperature of the space close to the user.

By determining whether or not the transmission IDs included in the communication data transmitted from the communication devices 110 and 210 match the corresponding receivable IDs previously stored in the management devices 130 to 330, the management devices 130 to 330 can ignore the communication data from communication devices 110 and 210 other than the corresponding communication devices 110 and 210.

By receiving the communication data from the communication device 210 by the air conditioner 350, even if the management devices 130 and 230 are disposed far apart from the communication device 210, the management devices 130 and 230 can readily manage the air conditioner 350 depending on the communication data. The communication device 210 can detect a physical quantity at a position close to the user and the air conditioner 350.

By providing the electric battery 113 for storing the electricity generated by the electricity generator 112, electricity can be stored over a long period of time to acquire the power sufficient to activate the communication device 110 in the normal mode, even if the amount of electricity generated by the electricity generator 112 is small.

In the first to third embodiments described above, the management devices 130 to 330 determine whether or not a transmission ID included in communication data matches a receivable ID, but the first to third embodiments are not limited to such an example. The transmission ID may not be included in the communication data. In such a case, the management controllers 123 to 323 do not need to determine whether or not the transmission ID and the receivable ID match. Therefore, in a case where the wireless receiver 131 or the unit communicator 133 does not receive the communication data during the transition time when the operation state of the air conditioners 150 to 350 is in the stop, the management controllers 123 to 323 send an operation command to cause the operation state of the air conditioners 150 to 350 to be in the setback, to the air conditioners 150 to 350 via the unit communicator 133.

What is claimed is:

1. An air conditioning system comprising:

a communication device including an electricity generator to generate electricity by receiving light;

a wireless transmitter to receive a supply of the electricity generated by the electricity generator and to transmit communication data wirelessly; and a communication controller configured to control the transmitter to transmit the communication data on a periodic basis, and an air conditioner including an air-conditioner main body to perform air conditioning; and an operation controller to control the air-conditioner main body, and configured to determine, while an operation state of the air-conditioner main body is in a stop, whether the communication data is not transmitted for a predetermined transmission time by the wireless transmitter indicating that light is not being received by the electricity generator of the communication device, and responsive to determining that the communication data is not transmitted in the stop, cause the operation state to be in a setback, the setback being a state in which the air conditioning is performed by the air-conditioner main body so that a temperature in a space where the air conditioner is placed does not exceed a predetermined limit temperature, the stop being a state in which the air conditioning is not performed by the air-conditioner main body.

2. The air conditioning system according to claim 1, wherein the limit temperature is at least one of an upper limit temperature or a lower limit temperature, the upper limit temperature is a temperature at which the air-conditioner main body needs to perform cooling, and the lower limit temperature is a temperature at which the air-conditioner main body needs to perform heating.

3. The air conditioning system according to claim 1, wherein the operation controller is further configured to determine, while the operation state of the air-conditioner main body is in the setback, whether a plurality of pieces of communication data is transmitted from the wireless transmitter within a predetermined recovery time, and responsive to determining that the plurality of pieces of the communication data is transmitted, cause the operation state to be in the stop.

4. The air conditioning system according to claim 1, further comprising:

a management device including a wireless receiver to receive the communication data wirelessly; and a unit communicator to communicate with the air conditioner, a management controller configured to send an operation command for causing the operation state to be in the setback to the air conditioner via the unit communicator, in a case where the wireless receiver does not receive the communication data for the transition time while the operation state is in the stop, the air conditioner further includes a device communicator to communicate with the management device, and the operation controller is further configured to cause the operation state to be in the setback in accordance with the operation command received by the device communicator.

5. The air conditioning system according to claim 4, wherein the communication device further includes a detector to detect a physical quantity, the communication data includes information indicating the physical quantity detected by the detector, the management controller is further configured to send the information included in the communication data received by the wireless receiver to the air conditioner via the unit communicator, and the operation controller is further configured to control the air-conditioner main body depending on the physical quantity indicated by the information received by the device communicator.

6. The air conditioning system according to claim 5, wherein the physical quantity is a temperature.

7. The air conditioning system according to claim 1, further comprising:

a management device, wherein the communication data includes communication device identification information that is identification information for identifying the communication device, the management device includes a wireless receiver to receive the communication data wirelessly;

a unit communicator to communicate with the air conditioner; and a management controller configured to determine whether or not the communication device identification information included in the communication data received by the wireless receiver matches a predetermined receivable identification information, and responsive to determining that the wireless receiver does not receive the communication data including the communication device identification information matching the receivable identification information for the transmission time while the operation state is in the stop, send an operation command for causing the operation state to be in the setback to the air conditioner via the unit communicator, wherein the air conditioner further includes a device communicator to communicate with the management device, and the operation controller is further configured to cause the operation state to be in the setback in accordance with the operation command received by the device communicator.

8. The air conditioning system according to claim 1, further comprising:

a management device including a unit communicator to communicate with the air conditioner; and a management controller to manage the air conditioner, wherein the air conditioner includes a wireless receiver to receive the communication data wirelessly; and a device communicator to communicate with the management device, the device communicator transmits the communication data received by the wireless receiver to the management device, the management controller is further configured to send an operation command for causing the operation state to be in the setback to the air conditioner via the unit communicator in a case where the unit communicator does not receive the communication data for the transition time while the operation state is in the stop, and the operation controller is further configured to cause the operation state to be in the setback in accordance with the operation command received by the device communicator.

9. The air conditioning system according to claim 8, wherein the communication device further includes a detector to detect a physical quantity, the communication data includes information indicating the physical quantity detected by the detector, and the operation controller is further configured to control the air-conditioner main body depending on the physical quantity indicated by the information included in the communication data received by the wireless receiver.

10. The air conditioning system according to claim 9, wherein the physical quantity is a temperature.

11. The air conditioning system according to claim 1, further comprising:

a management device, wherein the communication data includes communication device identification information that is identification information for identifying the communication device, the management device includes a unit communicator to communicate with the air conditioner; and a management controller to manage the air conditioner, the air conditioner includes a wireless receiver to receive the communication data wirelessly; and a device communicator to communicate with the management device, the device communicator transmits communication data received by the wireless receiver to the management device, the management controller is further configured to determine whether or not the communication device identification information included in the communication data received by the wireless receiver matches a predetermined receivable identification information, and send an operation command for causing the operation state to be in the setback to the air conditioner via the unit communicator in a case where the wireless receiver does not receive the communication data including the communication device identification information matching the receivable identification information for the transmission time while the operation state is in the stop, and the operation controller is further configured to cause the operation state to be in the setback in accordance with the operation command received by the device communicator.

12. The air conditioning system according to claim 1, wherein the communication device includes an electric battery to store electricity generated by the electricity generator; and the communication controller is further configured to cause the wireless transmitter to transmit the communication data in a case where the amount of electricity stored in the electric battery is larger than or equal to a threshold value.

13. A management device comprising:

a unit communicator to communicate with an air conditioner;

a wireless receiver wirelessly receiving communication data from a communication device upon the communication device generating electricity by receiving light; and a management controller configured to determine, while an operation state of the air-conditioner main body is in a stop, whether the wireless receiver does not receive the communication data for a predetermined transmission time by the wireless transmitter at the communication device indicating that light is not being received by the communication device, and responsive to determining that the communication data is not received in the stop, send an operation command for causing the operation state to be in a setback, to the air conditioner via the unit communicator, the setback being a state in which air conditioning is performed by the air conditioner and the temperature of a space where the air conditioner is placed is prevented from exceeding a predetermined limit temperature.

14. The management device according to claim 13, wherein the limit temperature is at least one of an upper limit temperature or a lower limit temperature, the upper limit temperature is a temperature at which the air-conditioner main body needs to perform cooling, and the lower limit temperature is a temperature at which the air-conditioner main body needs to perform heating.

15. The management device according to claim 13, wherein the management controller is further configured to determine whether or not communication device identification information included in the communication data received by the wireless receiver matches a predetermined receivable identification information, and responsive to determining that the wireless receiver does not receive the communication data including the communication device identification information matching the receivable identification information for the transmission time while the operation state is in the stop, send an operation command for causing the operation state to be in the setback to the air conditioner via the unit communicator.

16. The management device according to claim 13, wherein the communication data includes information indicating a physical quantity detected by a detector, the management controller is further configured to send the information included in the communication data received by the wireless receiver to the air conditioner via the unit communicator.

17. The management device according to claim 16, wherein the physical quantity is a temperature.

* * * * *